United States Patent [19]

Delfourne

[11] Patent Number: 4,690,068

[45] Date of Patent: Sep. 1, 1987

[54] INTER-CARRIAGE PASSAGE FOR A RAILWAY TRAIN

[75] Inventor: Paul Delfourne, Villeneuve-La-Garenne, France

[73] Assignee: R.A.T.P. Regie Autonome des Transports Parisiens, Paris, France

[21] Appl. No.: 782,687

[22] Filed: Oct. 1, 1985

[30] Foreign Application Priority Data

Oct. 2, 1984 [FR] France ..... 84 15100

[51] Int. Cl.[4] ..... B61D 17/20

[52] U.S. Cl. ..... 105/8.1

[58] Field of Search ..... 105/3, 4 R, 8 R, 15

[56] References Cited

U.S. PATENT DOCUMENTS

| | | | |
|---|---|---|---|
| 2,462,666 | 2/1949 | Omar | 105/8 R |
| 2,650,547 | 9/1953 | Anderson et al. | 105/4 R |
| 2,843,417 | 7/1958 | Wahl et al. | 105/3 |
| 2,884,869 | 5/1959 | Haug | 105/4 R |
| 2,925,049 | 2/1960 | Frei | 105/8 R |
| 2,935,031 | 5/1960 | Cripe | 105/4 R |
| 3,399,632 | 9/1968 | Dean | 105/15 |
| 3,884,155 | 5/1975 | Moroshick | 105/3 |
| 4,325,562 | 4/1982 | Yamada et al. | 180/215 |
| 4,458,911 | 7/1984 | Chadwick et al. | 105/8 R |

FOREIGN PATENT DOCUMENTS

| | | | |
|---|---|---|---|
| 1051892 | 9/1955 | Fed. Rep. of Germany | 105/8 R |
| 1072641 | 9/1958 | Fed. Rep. of Germany | 105/15 |
| 565053 | 7/1957 | Italy | 105/4 R |

*Primary Examiner*—Robert B. Reeves
*Assistant Examiner*—Charles Barrett
*Attorney, Agent, or Firm*—Franklin D. Wolffe; Morris Fidelman

[57] ABSTRACT

The invention relates to an inter-carriage passage for a railway carriage set comprising an intermediate bodywork member having a generally annular shape connecting the adjoining ends of two carriages.

In accordance with the invention, the intermediate bodywork member is connected to the two adjoining carriage ends so as to be maintained in a radial position; this intermediate member is positioned on each carriage end by means of deformable pneumatic joints.

The invention is especially applicable to metro (rapid transit) trains with short carriages and radial axles.

2 Claims, 10 Drawing Figures

INTER-CARRIAGE PASSAGE FOR A RAILWAY TRAIN

BACKGROUND OF THE INVENTION

This invention relates to an inter-carriage passage between two carriages of a railway set or train, which comprises a bodywork member presenting walls, ceiling and floor in a generally annular form overlapping with the adjoining ends of the carriages. The invention is particularly, but not exclusively, applicable to railway sets with short carriages such as light metro trains (rapid transit) and tramways.

DESCRIPTION OF THE PRIOR ART

In a prior train of short carriages, the inter-carriage passages were not utilizable by passengers during the journey in the same way as the rest of the floor area of the train, so that the floor space was not fully continuous from one end of the carriage set to the other. This was a particular disadvantage in this type of train, as inter-carriage passages were more numerous. Moreover, passengers were discouraged from standing in the inter-carriage passages if the movements of the intermediate bodywork member relative to the two carriages it joins were excessive. Also, as the number of passages increased, the cost was a more significant factor.

OBJECTS OF THE INVENTION

An object of the invention is to provide an inter-carriage passage which may readily be used by passengers during the journey.

A more particular object of the invention is to provide an inter-carriage passage in which relative movements are reduced.

Another object of the invention is to provide an inter-carriage passage which is of simple and inexpensive construction.

BRIEF DESCRIPTION OF THE INVENTION

The present invention provides in a railway carriage set, an inter-carriage passage comprising an intermediate bodywork member of generally annular shape which overlaps the adjoining carriage ends, and positioning means for positioning said intermediate member so that its transverse median plane extends midway between said carriage ends generally radially with respect to any curve on which said carriage set is disposed, said positioning means including deformable pneumatic joint means between said intermediate member and the overlapping carriage ends.

Since the intermediate bodywork member is maintained radially, relative displacements with respect to the adjoining carriage ends are divided equally between the two ends, which halves the relative displacements compared to a situation in which the intermediate member moved totally asymmetrically relative to the two carriage ends. Moreover, the use of deformable pneumatic joint means, interposed between the intermediate bodywork and the overlapping carriage ends enables all the movements of the intermediate member relative to the carriage ends to be absorbed, whatever the directions of movement. The intermediate member behaves almost like a ring which is floatingly mounted relative to the adjoining carriage ends.

In a preferred embodiment of the invention, said positioning means includes first, second and third linkages connected between said adjoining carriage ends and accommodating expansion and contraction of the inter-carriage gaps, said first linkage being disposed at the upper part of said intermediate member and pivoted on a point in the longitudinal median plane of said intermediate member, and said second and third linkages disposed at the lower part of said intermediate member and pivoted on respective points on said intermediate member symmetrically on opposite sides of said longitudinal median plane thereof.

In another preferred embodiment of the invention, said carriage set comprises radial axle means carrying both said carriage ends, said positioning means including radially extending guide means mounted on said axle means for positioning the lower part of said intermediate member, and linkage means disposed at the upper part of said intermediate member and pivoted on a point in the longitudinal median plane of said intermediate member, said linkage means being connected between said adjoining carriage ends to accommodate expansion and contraction of the inter-carriage gap.

In an advantageous embodiment of the invention, said pneumatic joint means includes first and second pneumatic joint members which are disposed between said intermediate member and respective ones of said overlapping carriage ends, said joint members surrounding the passage substantially completely, whereby to form substantially continuous seals between said intermediate member and the respective carriage end.

DESCRIPTION OF THE DRAWINGS

Other features and advantages of the invention will appear from the following description, given by way of example, with reference to the accompanying drawings, in which.

DESCRIPTION OF THE EMBODIMENTS

Figure 1:
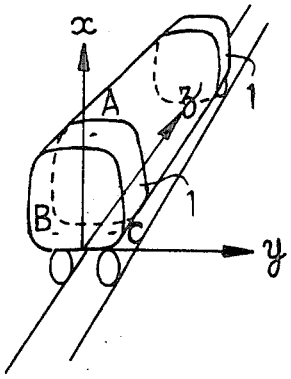
FIG. 1 is a diagram illustrating the radial positioning of an intermediate bodywork member in an inter-carriage passage according to an embodiment of the invention.

FIG. 1 shows part of a railway train, in which appear only the intermediate bodywork members 1. The intermediate members are maintained in the radial plane, which means that they can move in the transverse x, y axes but not in the z axis. This maintenance is obtained by means of three linkages which will be described below, namely a first linkage pivoted at a point A disposed in the plane of longitudinal symmetry of the intermediate member 1 and two linkages pivoted at respective points B and C which are disposed symmetrically relative to this plane. These linkages are connected to the two carriages joined by the intermediate member 1 and for each pivot point, the linkages swing symmetrically relative to the respective carriages. As shown in FIG. 1, the central linkage is disposed in the upper part of the intermediate member 1 and the symmetrical side linkages are disposed in the lower part of the intermediate member 1.

Figure 2:
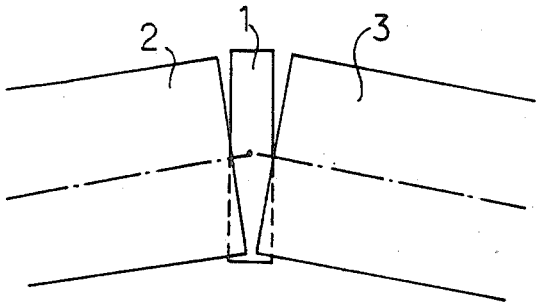
FIG. 2 is a schematic plan view showing the relative displacement of the intermediate bodywork member and the carriages it joins.

FIG. 2 shows the relative movements of the intermediate member 1 with respect to the adjacent ends of the adjoining carriages 2 and 3. It will be seen that the displacements of the intermediate element relative to the carriages is in opposite directions on opposite sides of the train, but of equal absolute values, which means that the approach or separation of the parts in a curve is the same in absolute value on the inside and on the outside of the curve. Consequently this displacement is half the biggest displacement which would occur if the intermediate member was fixed on one carriage.

In this embodiment of the invention, the relative movements of the carriages and the intermediate member are absorbed by at least one deformable pneumatic joint interposed between the intermediate element and the overlapping end part of a respective one of each of the adjoining carriages 2 and 3; the deformable pneumatic joints are disposed symmetrically relative to the transverse median plane of the intermediate element. The deformable pneumatic joints must be disposed so as to absorb relative movements in all directions, that is to say that they must be present on the lower part of the intermediate element 1, on its sides and on its upper part.

Figure 3:
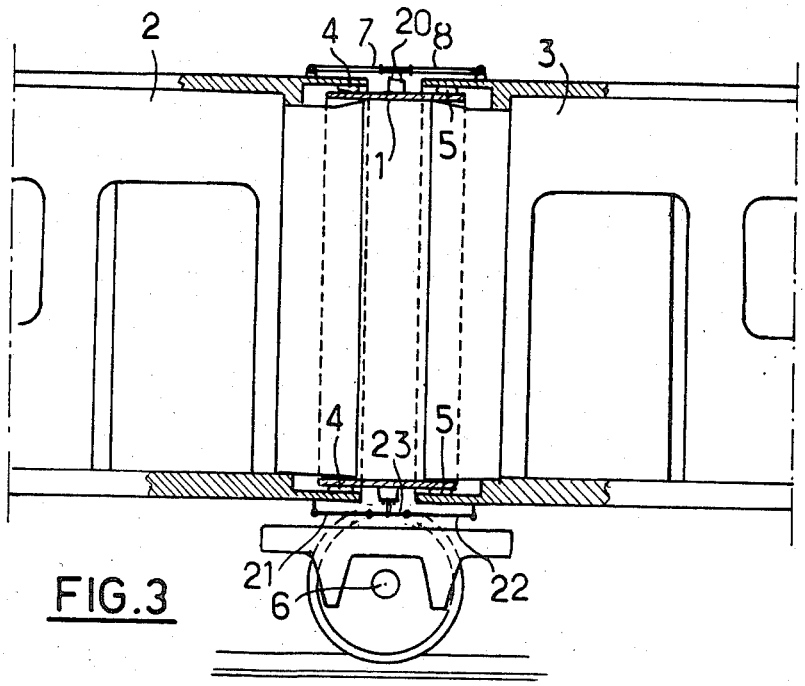
FIG. 3 is a longitudinal sectional view of part of a train in accordance with one embodiment of the invention.
Figure 4:
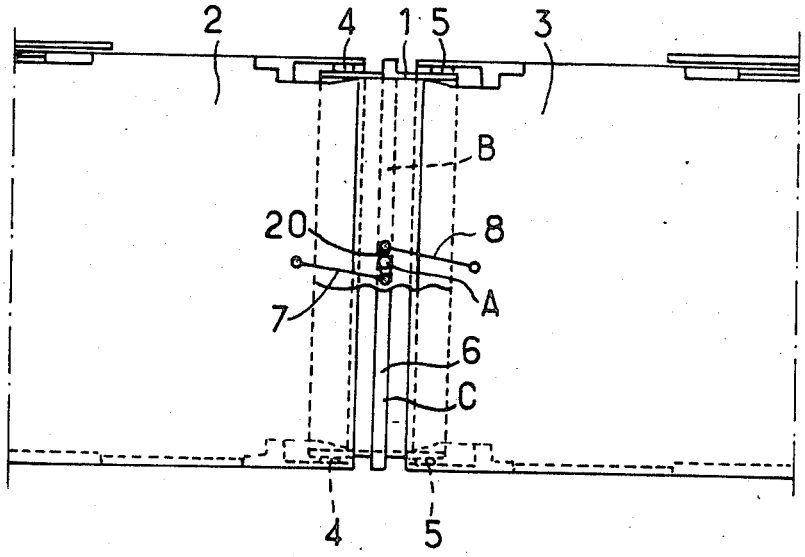
FIG. 4 is a simplified plan view corresponding to FIG. 3.

It is particularly advantageous to dispose a single generally annular joint to surround the intermediate member 1 substantially completely on each side. FIGS. 3 and 4 show such joints at 4 and 5 respectively.

In the embodiment of FIGS. 3 and 4, three linkages are used to achieve the maintenance of the intermediate member in a radial position, namely three linkages disposed respectively at the upper (A) and two lower (B and C) points. FIG. 4 shows more particularly two link rods 7 and 8 which are each connected at one end to the respective carriages 2 and 3 and at the other end to respective ends of a third link rod 20 which is pivoted on the point A which is central to the upper part of the intermediate member. At the lower points B and C, similar linkages are disposed, one of which is shown in FIG. 3 and comprises two end link rods 21 and 22 connected by a third intermediate link rod 23 pivoted on the point B.

It follows that the intermediate member 1 is maintained in the radial position that is to say in the plane bisecting the space between the two carriages 2, 3.

Figure 5:
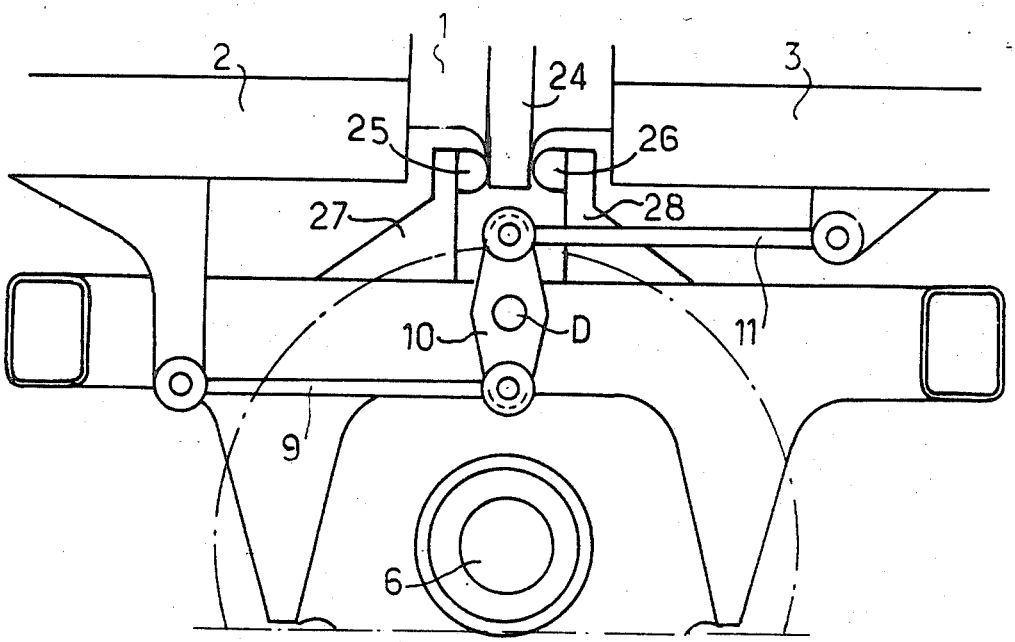
FIG. 5 is a longitudinal sectional view of a detail showing the guidance of the intermediate bodywork member in the case of a radial axle.

In the embodiment shown in FIG. 5, the railway train comprises radial axles 6, each radial axle 6 being disposed exactly in the middle between two carriages 2 and 3 and supporting half the weight of each of the carriages 2 and 3.

Advantageously in this case, the lower sets of linkages are replaced by guides solid with the radial axle, which maintain the intermediate member 1 in a radial position relative to the longitudinal direction of the z axis.

FIG. 5 shows the lateral connections by linkages which maintain the axle 6 in radial position relative to the carriages 2 and 3. The linkages are symmetrical relative to the longitudinal axis and each linkage comprises two link rods 9 and 11 each of which is hinged at one end on the respective carriages 2 and 3 and at the other end to an intermediate link rod 10 which is pivoted about a point D solid with the axle 6.

FIG. 5 also shows guide means which replace the lower guide linkages of FIGS. 3 and 4, and which are also disposed at the points B and C in the lower part of the intermediate member 1. The intermediate member 1 bears at its lower edge a transversely extending rib 24 and each guide means comprises essentially two abutments 25 and 26 which are disposed on opposite side of the transverse rib 24 and are borne by supports 27, 28 solid with the axle 6. It will be understood that these guide means admit displacement of the intermediate member 1 in the x and y directions but prevent its displacement in the z axis (see FIG. 1).

Figure 7:
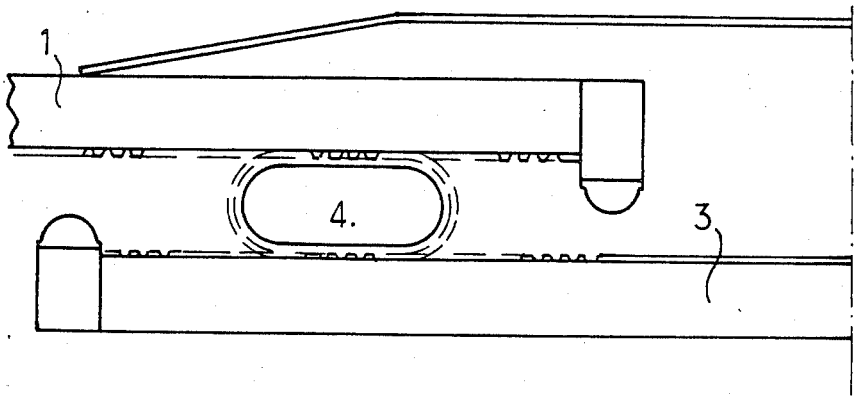
FIGS. 7 to 9 are longitudinal sections of a deformable pneumatic joint in the bodywork member of FIG. 5.
Figure 8:
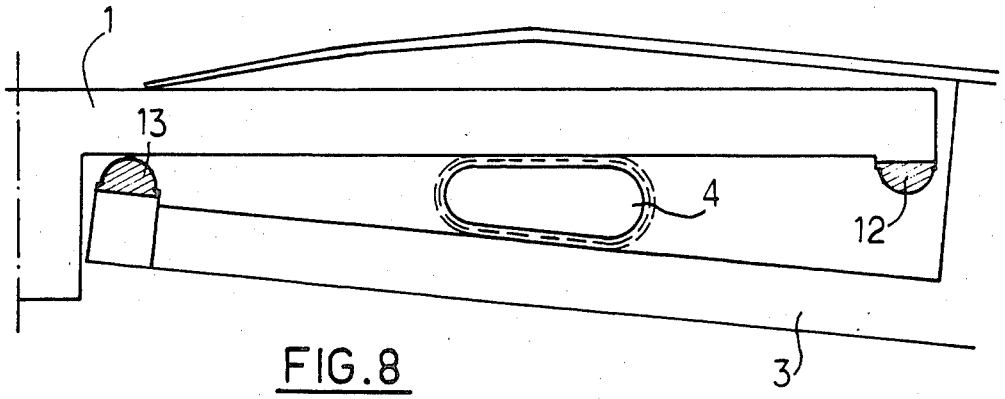
Figure 9:
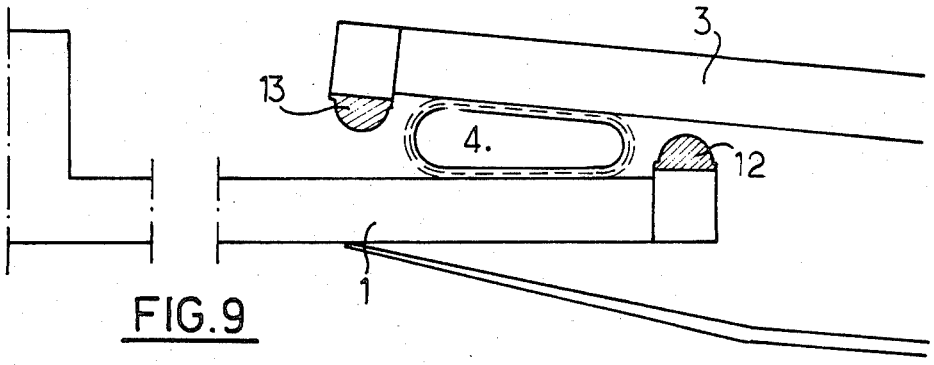

FIGS. 7 to 9 shows an embodiment of a deformable pneumatic joint 4, 5.

FIG. 7 shows the relevant members in their rest position, with zero relative displacement.

FIG. 8 shows the members with deformation of the lateral part of the joint 4 which is disposed on the inside of a curve on which the train is situated, and FIG. 9 shows a similar view for the outside of the curve.

It will be appreciated that the pneumatic joint 4 deforms and is displaced between the intermediate member 1 and the carriages 2 and 3 during their relative movement.

Advantageously, respective abutments 12, 13 are provided at the ends of the parts 1 and 3 so as to limit the displacements and avoid excessive deformation of the joint 4.

Advantageously, to ensure that the joint moves without sliding on the faces of the intermediate member and the carriage (sliding is likely if the contracting surfaces are smooth), the joint 4 is provided with male splines which mesh with splines provided on the mating surfaces of the carriage and the intermediate member 1.

Figure 10:
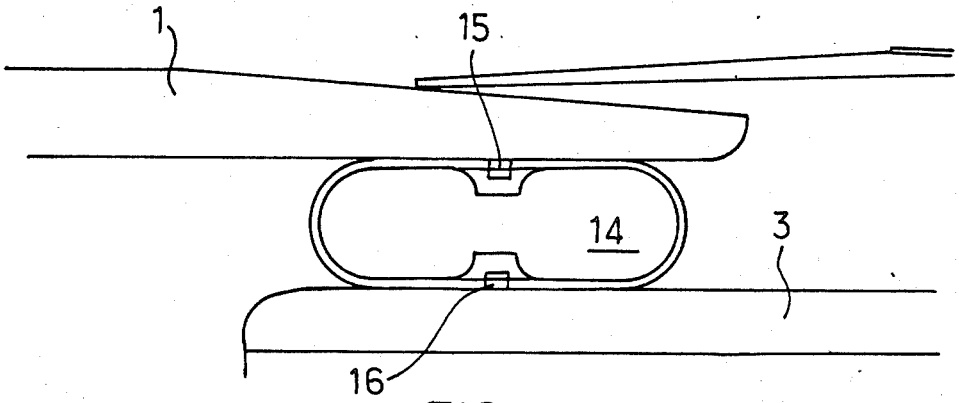
FIG. 10 is a view corresponding to FIG. 7 of an alternative deformable pneumatic joint.

FIG. 10 is a section of an alternative embodiment of the deformable elastic joint, ensuring the absence of sliding of the joint relative to the two members between which it is disposed. The joint 14 shown in FIG. 10 is smooth and comprises two opposite fixing lines 15 and 16 by which the joint is secured to the carriage 3 and the intermediate member 1. The relative displacements of these two members are also admitted by deformation of the joint 14.

By way of example, the joint shown in FIGS. 7 to 10 constitutes in its free condition the form of a large inner tube (that is to say in the shape of a toroid); the abutments 12 and 13 are made of synthetic material having high wear resistance such as a material having closed cellular consistency (foamed).

The inflation pressure of the joints may be relatively low, given the large bearing area ; the pressure may be 0.3 to 0.5 bars, for example.

In extreme conditions, that is to say curves of 30 meters, in the horizontal parts of the joints (that is to say the roof and floor), the joint is subjected to high torsion (twist) equal to about 13° per decimeter of length, which can easily be accepted by available materials.

In the case of a cant of 0.6%, the lateral displacement of the joint ring relative to the carriage at the level of the roof is typically a maximum of 30 mm; such a displacement can be absorbed by deformation of the walls of the joint.

It will be appreciated that the invention enables an inter-carriage passage structure to be produced which is particularly simple and consequently inexpensive; relative displacements of the intermediate member with respect to the carriage ends are small and are very readily absorbed by the pneumatic joint.

In the case where the joints are continuous and completely surround the intermediate member, rolling noise is attenuated, the joints forming a seal against noise and dirt ingress between the intermediate member 1 and the carriage ends 2 and 3.

The abutments 12 and 13 serve to limit the deformation of the pneumatic joint and also to absorb possible overloads.

Figure 6:
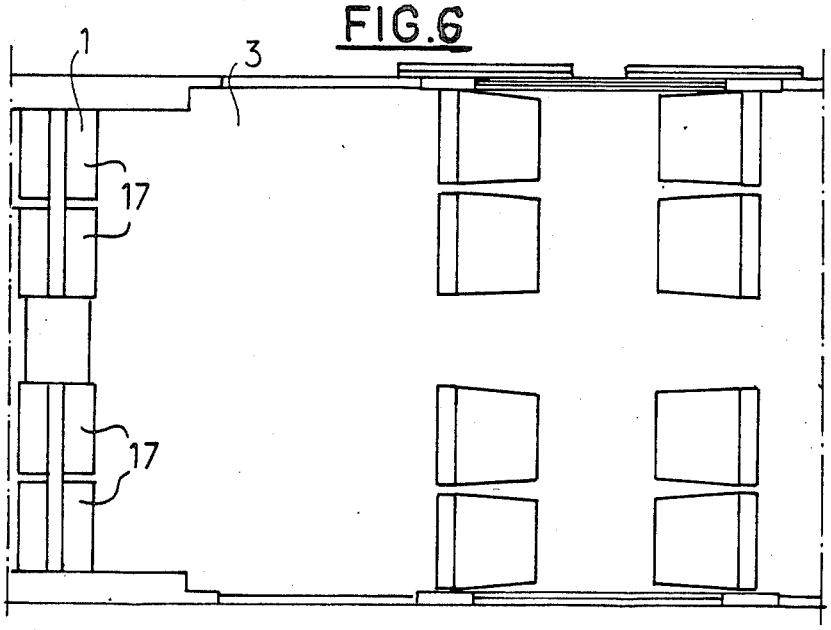
FIG. 6 is a plan view showing the equipment of an inter-carriage passage in an embodiment of the invention.

As shown in FIG. 6, the invention provides a passage between adjoining carriages which can be used without danger by passengers during movement of the train. Advantageously, folding (tilt) seats 17 are provided in the intermediate bodywork member 1 on each side of its transverse median axis so as to protect the zones of maximum movement. In this way one can avoid passengers standing in the places where the relative movements are biggest.

The invention enables a railway carriage set or train to be produced which has considerable continuity in its lines over its length from one end to the other, only a slight increase in wall thickness indicating the passage from one module to another; passengers will no longer make a distinction between inter-carriage passages and the rest of the floor area of the carriage set.

The above description is given only by way of example and is not limitative. It is clear that modifications and alternatives can be made within the scope of the invention. In particular, the invention also applies to the case where the ends of the carriages 2 and 3 and the intermediate member 1 are disposed in inverted relationship, that is to say where the sides of the intermediate element are located outside the carriage ends 2 and 3 instead of inside them as shown in the drawings.

I claim:

1. In a railway carriage set, an inter-carriage passage comprising an intermediate bodywork member of generally annular shape in overlapping relation with adjoining ends of two carriages of said carriage set, a single axle carrying said adjoining ends, and positioning means for positioning said intermediate member so that a transverse median plane thereof extends midway between said carriage ends and generally radially with respect to any curve on which said carriage set is disposed, said positioning means comprising cooperating guide means on said axle and on said intermediate body member for maintaining said transverse median plane in substantial alignment with said axle, and linkage means disposed at an upper part of said intermediate member and pivoted on a point in a longitudinal median plane of said intermediate member, said linkage means being connected between said adjoining carriage ends to accomodate expansion and contraction of an inter-carriage gap, a deformable pneumatic joint disposed between the overlap of said intermediate member with each said carriage end, said joint being hollow and generally toroidal in shape so as to provide a substantially continuous seal of said overlap, and splines on said pneumatic joint in meshing engagement with respective splines on each of said carriage and said intermediate body member in order to eliminate sliding movement of said joint relative to said carriage and said intermediate body member.

2. An inter-carriage passage as claimed in claim 1 and including at least one seat disposed above transition zones between said intermediate member and said adjoining carriage ends.

* * * * *